US006254134B1

(12) United States Patent
Panizza

(10) Patent No.: US 6,254,134 B1
(45) Date of Patent: Jul. 3, 2001

(54) SHOCK ABSORBING DEVICE FOR SKI POLES, WALKING STICKS, CRUTCHES AND SIMILAR ARTICLES

(75) Inventor: Paolo Panizza, Bassano Del Grappa (IT)

(73) Assignee: Gabel srl, Vicenza (IT)

( * ) Notice: Subject to any disclaimer, the term of this patent is extended or adjusted under 35 U.S.C. 154(b) by 0 days.

(21) Appl. No.: 09/160,694

(22) Filed: Sep. 25, 1998

(30) Foreign Application Priority Data

Sep. 29, 1997 (IT) ..... VI97A0166

(51) Int. Cl.[7] ..... A63C 11/22; A45B 9/04
(52) U.S. Cl. ..... 280/819; 280/821; 135/82
(58) Field of Search ..... 280/809, 812, 280/819, 820, 823, 826, 821; 135/65, 75, 82, 86

(56) References Cited

U.S. PATENT DOCUMENTS

| | | | | |
|---|---|---|---|---|
| 1,336,844 | * | 4/1920 | Klousnitzer | 135/82 |
| 1,753,065 | * | 4/1930 | Payne | 135/82 |
| 1,817,829 | * | 8/1931 | Lanning | 135/82 |
| 2,397,499 | * | 4/1946 | McGowan | 135/82 |
| 2,414,758 | * | 1/1947 | Moss | 135/82 |
| 2,675,014 | * | 4/1954 | Powers | 135/82 |
| 2,888,022 | * | 5/1959 | Fanning | 135/82 |
| 3,158,162 | * | 11/1964 | Reel | 135/85 |
| 4,958,651 | * | 9/1990 | Najm | 135/82 |
| 5,810,038 | * | 9/1998 | Carpinella | 135/77 |

* cited by examiner

*Primary Examiner*—Brian L. Johnson
*Assistant Examiner*—Bridget Avery
(74) *Attorney, Agent, or Firm*—Bucknam and Archer

(57) ABSTRACT

A shock absorbing device for poles for skiing, for excursions, for walking, for crutches and similar articles has two structures (1) and (2) in general cylindrical, coaxial with the longitudinal axis of the structure to be dampened. One of the two structures is partially placed within the other with the possibility of sliding with respect to the same corresponding to the stresses which are applied on the structures during use. Between the two structures there is placed an elastic material capable of dampening the stresses in two directions. The device is characterized by the particular shape of the piece of elastic material.

5 Claims, 3 Drawing Sheets

5
13
14

13

12
11

11
12
11

12
5

5
1
11
12
14
2

SHOCK ABSORBING DEVICE FOR SKI POLES, WALKING STICKS, CRUTCHES AND SIMILAR ARTICLES

FIELD OF THE INVENTION

The present invention relates to a shock absorbing device for rods or poles being used for skiing, for excursions, for walking, for crutches and similar articles.

BACKGROUND OF THE PRIOR ART

It is known that the practice of skiing both when one goes downhill as well as at the bottom, requires the use of poles in a variety of situations with variable intensity and frequency above all as a function of the particular type of activity being carried out. In particular, during skiing when one goes downhill the poles are used as assistance elements during the phases of the departure and thrust in maintaining the equilibrium and in applying the trajectory, and also when one goes uphill.

On the contrary, in sking at the bottom and also during the practice of walking in ski boots, the poles are used to complete the motion of the legs following typically the cadence in a synchronous manner. Both these situations involve stresses of different nature and intensity which are transmitted to the limbs which maneuver the poles. Specifically in sking when one goes downhill these stresses are typically short, of great intensity and relatively sporadic and irregular. On the contrary, in skiing at the bottom, the stresses result more prolonged and of lower intensity but with high frequency of repetition typically equal to the forward steps. In every case for activities which are carried out with substantial intensity and/or extension of the period of time and in a particular manner for professional athletes, these stresses are capable of favoring or determining pathological conditions of the articulations of the upper limbs, in particular the wrists and the elbows. For the purpose of obviating these drawbacks there have been already adopted for some time shock absorbing devices above all on the poles which are used for the practice of skiing on a road (ski roller) and on the poles being used for pedestrian excursions. These known devices consist essentially of a simple spiral spring which is placed internally and coaxially with the pole. These devices may be placed at the level of the handgrips, or the tips, but also in any other intermediate position of the pole.

In actual practice these devices have given unsatisfactory results and in some instances have produced the opposite result during use. The absence of damping in fact brings about a constant tension of muscles and tendonitis of the limbs in elastic bearing and favor the occurrence of troubles such, for instance in the tendonitis In addition, these devices are capable of increasing the total weight of the pole and also increase the final cost for the user. These devices have been partially eliminated with a shock absorbing device for poles and similar articles described in Italian patent application, No. VI95A000131, dated Aug. 3, 1995, filed in the name of the applicant as in the present application. This device provides similarly to the devices of known type the presence of two cylinders coaxial with the longitudinal axis of the structure to be dampened, one of the two cylinders being placed partially within the other, with the possibility of sliding with respect to the same in the presence of stresses which occur on the structure during use following the contact with the bearing surface and is characterized mainly by the fact that it utilizes an elastomer as the elastic means.

Both the device described hereinabove as well as other devices which have been proposed for the same purpose operate with a damping action only in one direction of motion, generally from the position of rest in the direction of compression so that the result is they are substantially rigid in the opposite direction. Consequently the return of the rest position of the elastic element following the removal of the load causes a dry recoil which for instance amounts to a nuisance also because of the noise being generated over prolonged use.

SUMMARY OF THE INVENTION

An object of the present invention is to provide a shocking absorbing device for poles and similar articles which is free of the drawbacks described hereinabove and which in particular is effective in a dampening action in both the two phases, that is the phase of compression followed by the phase of traction. In particular with the device of the present invention in addition to achieving a shock absorbing action of the impact of the pole with the ground in a manner to generate a feeling of comfort in the limb which performs the maneuver the following results are possible:

- the axial motion is adequately dampened;
- the relation between both the compression force or positive force and the traction force or negative force and the deformation does not result linear with substantial initial yielding and a progressive stiffening;
- transmission of the maximal pair required by the internal blocking mechanism which has an expansion screw and which is ordinarily adopted in the telescopic poles for the purpose of joining reciprocally the parts which constitute the pole and/or the pole with the handgrip;
- the device which is contained in the interior of the pole or in one of the portions of the pole requires a minimal axial space, has substantially reduced weight and allows to assemble rapidly the various components with economical results.

The following results are achieved according to a first embodiment of the invention by providing that in the known constructive solution described hereinabove, that is the constructive solution composed of two cylinders which are coaxial and which slide reciprocally, the intermediate elastic element results firmly anchored with its two opposite bases to the corresponding surfaces of the bearing of the two above bodies.

As it is easily understandable with this constructive device the shock absorbing action occurs in addition to obviously during the compression phase of the elastic element also during the subsequent expansion phase, that is the traction phase due to the internal elastic return which the same structure being expanded carries out.

For the purpose of preventing that the return course, that is the expansion course turn out to be excessive and causing the yielding of the elastic element or the separation from the bearing bases, there is provided the action of a structure which carries out a rigid end course which intervenes after a certain predetermined traction course. This end course structure is advantageously applied to the extremity of a floating shaft, the latter being integral with one of the two coaxial cylindrical bodies which slide reciprocally one with the other.

According to another embodiment of the invention for the purpose of generating a shock absorbing action both during the compression as well as during the traction phase, there is provided the use always in the interior of the coaxial cylindrical bodies which slide reciprocally one with respect to the other, of two elastic means which operate on the two faces of the common bearing face of the cylinder which is placed internally.

With this second constructive solution the shock absorbing action is further reinforced by providing that at least one of the two elastic means which are placed one opposite to the other has a dimension such that it may slide against the containing wall so that during the compression phase it operates as a typical friction piston.

A good shock absorbing device which offers constant elastic elements and suitably not linear, in addition to the use of an elastomer is achieved by using conical or bi-conical metallic springs.

The maximal compactedness and light weight of the shock absorbing device is achieved by using a single elastic element which operates both during the traction and during the compression phase and which is provided with a lock for stopping the shaft, the shaft being obtained with an elastomer of a foamed polyurethane of the type for instance commercially known under the names of CELLESTO or POLYCEL or with metallic springs of the type "bovolo" which means a twisting spring with conical helix and rectangular section or particular conical springs in lamination which require minimal space under equal excursion travels and which due to their particular constructive form may be obtained with an inherent damping. The avoidance of the reciprocal rotation between the elements which constitute the pole and/or between the pole and the handle is achieved advantageously by providing that the central shaft offer a non-circular section so it is possible to transmit a twisting torque directly from the external cylinder to which it is anchored to the internal cylinder within which it slides without requiring the use of further guides or extensions such as in the known devices which negatively increase the space and this becomes particularly significant in telescopic poles in which there are several parts constituting the pole.

Finally there is provided that the end of the course of the floating shaft is achieved by means of flexible tongues which engage the extremity of the same shaft during its traction course and stop it.

Constructively the shock absorbing device of the present invention in its several forms results to be constituted by a limited number of components, none of which requires a complex construction.

BRIEF DESCRIPTION OF THE DRAWINGS

This and other features of the invention will be described in more detail hereinbelow by reference to particular forms which are provided by way of non-limiting examples by reference to the accompanying drawings of which:

As shown in FIGS. 1, 2 and 3, the device of the invention contains schematically a first member (1) which in general is cylindrical and is disposed externally and by way of example could be made integral with the handgrip of the pole, the handgrip being designated **(1*a*) and shown in phantom in FIG. 3**.

Figure 1:
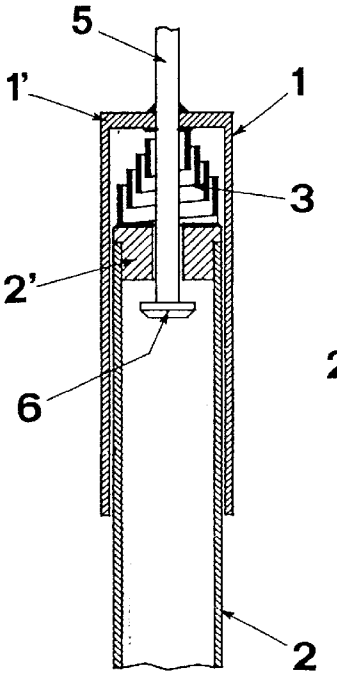
FIGS. 1, 2 and 3 show schematically in cross section the device of the present invention in which are inserted three different elastic means, respectively a metallic spring of the "bovolo" type, an elastomer and two elastic means placed one against the other.
Figure 2:
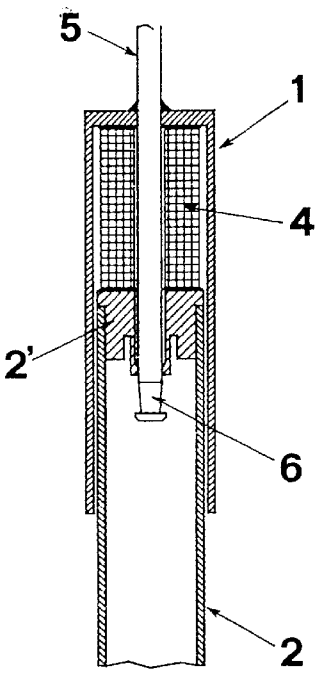

In the interior of the first member (1) there is inserted partially a further element (2) which is also cylindrical and which has the possibility of sliding relatively to the first member in an essentially axial direction. By way of example, the element (2) may be integral with that part of the pole which is intended to be effectively in contact with the bearing surface. Between the end plates (1') and (2') of member (1) and element (2) which are cylindrical, the end plates being opposite one to the other, an elastic member is placed. The latter according to the first embodiment of the invention is constituted by a metallic spring (3) of the "bovolo" type while according to a second embodiment of the invention the elastic member is constituted by elastomer (4). Both elastic members (3) and (4) are held in place by means of floating shaft (5) which is integral with end plate (1') and which extend through end plate (2').

A first novel feature of the invention consists of providing that the two elastic members (3) and (4) described hereinabove have both bases of rest on the bearing surface firmly anchored to the corresponding end plates (1') and (2').

Several manners of anchoring may be used such as mechanical means with adhesive glues.

It is evident that when due to the stresses of the rest surface/the cylindrical element (2) is inserted to a greater extent within the external cylindrical member (1) a deformation of the elastic member results which)due to its elasticity produces the desired shock absorbing or damping action during compression. It is also evident that after this effect ends, the elastic member expands and and always due to its elasticity it produces a absorbing action during the traction.

In order to suitably regulate the amplitude of the return course of the elastic member and to prevent a yielding result, there is provided a structure (6) which provides for the end of the course, this structure being applied to the end of the floating shaft (5), the latter being blocked on the base (2') according to manners which will be described hereinbelow.

An action of dampen both during the compression and during the traction stage is also achieved with a solution which provides for the use of two elastic member (7 & 8) which are counterposed one to the other and which act on the same base 2'. In particular the lower elastic member (8) is added to the upper elastic member hub (7), the lower elastic member (8) being blocked by means of pan (9) attached to the end of the floating shaft (5).

Figure 3:
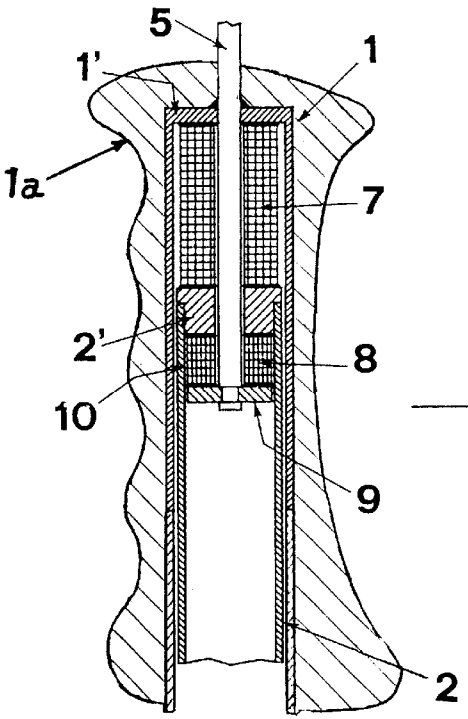

It is evident as shown in FIG. 3 that during the compression phase there is generated an action of damping due to the elastic member (7) which is compressed and also an action of damping produced by the elastic member (8) which is being lengthened. Analogously during the subsequent phase of traction the action of damping results after the elastic member (7) has lengthened, the latter being braked by the elastic member (8) which is compressed.

In order to increase the effect of damping in both directions there is provided that a portion or the entire lateral surface (10) of one of the two elastic members, preferably the lower member (8) comes in contact with the surface of the corresponding containing element.

Figure 5:
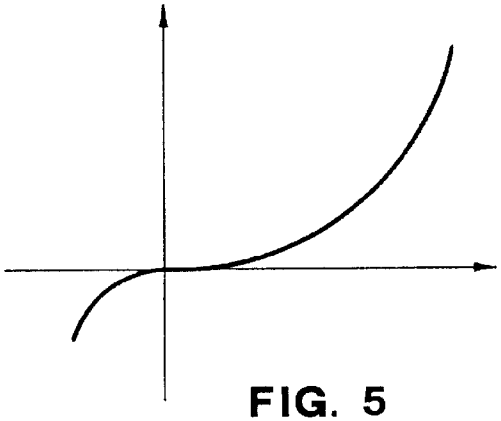
FIG. 5 is a diagram showing the relation between the deformation and the force being applied with reference to the embodiment of FIG. 3.
Figure 4:
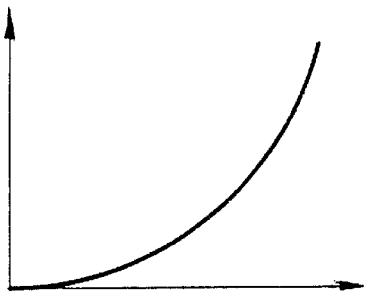
FIG. 4 is a diagram showing the relationship between the deformation and the force being applied with reference to the embodiments of FIGS. 1 and 2.

In both constructive solutions described hereinabove non-linearity is obtained between the deformation and the applied load as shown in FIG. 4 relative to the use of a single elastic member and in FIG. 5 due to the use of two elastic members which are placed one against the other.

Several constructive means (6) for ending the course are shown in FIGS. 6–18. According to a first embodiment of the means for ending the course the end plate (2') of element (2) is constituted by a member (11) which is provided with tongues (12). The latter are flexible and during the compression conditions shown in FIG. 6 they loosen coming in contact with body (13) of the floating shaft (5) but during the conditions of traction after the shaft reenters they provide to block the same becoming wedged in the tapered portion (14) which is formed in the end of the same shaft as shown in FIGS. 6 and 7.

Figures 6, 7, 8, 9, 10, 11, 12:
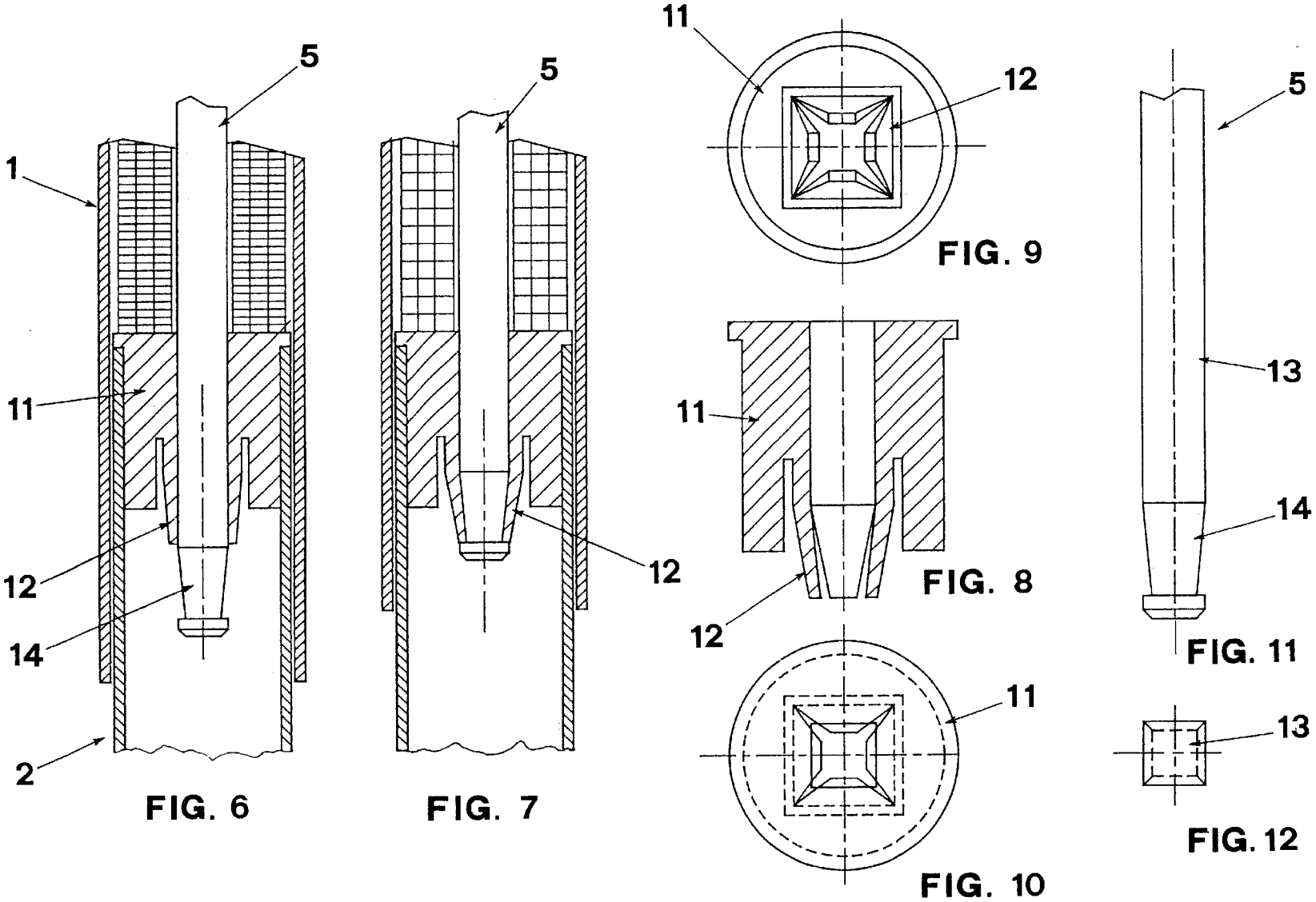
FIGS. 6 and 7 illustrate a first embodiment of the invention respectively in conditions of compression when the device is functioning and in the conditions of rest during traction.
FIG. 8 is an elevational view in cross section of the central hub which is used in the device of FIGS. 6 and 7.
FIGS. 9 and 10 show a planar view respectively from the bottom and from the top of the hub of FIG. 8.
FIG. 11 shows the end of the floating shaft which is present in the device of FIGS. 6 and 7.
FIG. 12 is a planar view of the shaft of FIG. 11.

FIGS. 8 and 12 show in particular the constructive form of member (11) and the end of the floating shaft (5).

Figures 13, 14, 15, 16, 17, 18:
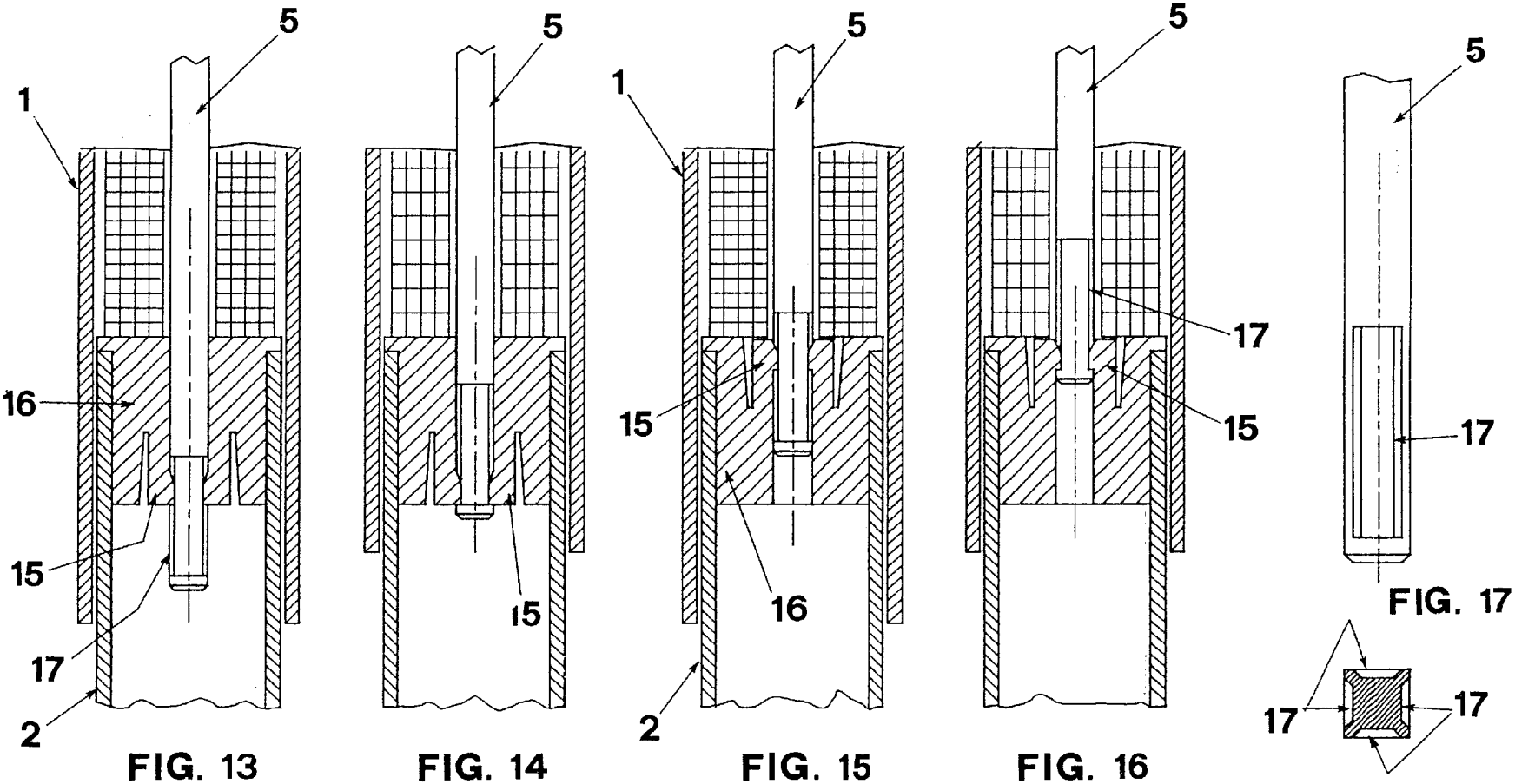
FIGS. 13 and 14.
FIGS. 15 and 16 illustrate respectively a second and a third embodiment of the invention in conditions of compression and rest.
FIG. 17 shows the end of the floating shaft present in the embodiments of FIGS. 13 and 16.
FIG. 18 shows a transversal cross section of the shaft of FIG. 17.

A second embodiment of the structure intended to achieve the end of the course which is used when it is required to have minimum space as shown in FIGS. 14 and 18 consists of providing the flexible tongues (15) totally contained in the interior of member (16). Further these tongues engage in the interior of the longitudinal cavities (17) which are formed at the end of the body of the floating shaft (5).

Specifically the minimum amount of space of the shock absorbing device is obtained with a constructive solution which provides for the flexible tongues (15) to be placed in the upper part of member (16) in such a manner that the end of the floating shaft (5) remains always in the interior of the body of the same floating shaft as shown in FIGS. 15 and 16.

Finally as shown in FIGS. 11 and 12 and 17 and 18 the portion of the floating shaft (5) which is engaged with members 11 and 16 of the end plate (2') has a quadrilateral cross section as shown in FIGS. 12 and 18 so that the rotations are avoided and the maximum pair of hooking is transmitted.

The location of the device along the pole does not matter from a functional point of view. In the case in which the pole is used as a ski pole, however, it is preferable to make it integral with the handgrip because in this manner the effect of the device on the total inertia moment with respect to the wrist is reduced to a minimum.

It should be noted that the present invention may be used not only with ski poles but also for pedestrian excursions or for walking or also for other devices used for deambulation such as crutches and similar articles used by unfortunate people who need such devices.

What is claimed is:

1. A shock absorbing device for an elongate structure adapted for contact with a bearing surface and suitable as a ski pole, walking stick, crutch, for damping in both compression and extension, said structure including a generally cylindrically shaped member (1) and a generally cylindrically shaped element (2) telescopically disposed with respect to member (1), member (1) and element (2) being coaxial with said elongate structure and being telescopically movable with respect to each other in response to stresses imparted to said structure from contact with said bearing surface, said shock absorbing device comprising:

a first end plate (1') on said member (1) and a second end plate (2') on said element (2);

a first elastic member (7) having a first base surface anchored to said first end plate (1') and a second base surface anchored to said second end plate (2');

a second elastic member (8) disposed within said element (2) and engaging said second end plate (2') in opposition to said first elastic member (7), whereby said first and second elastic members act to dampen in both compression and extension.

2. The shock absorbing device according to claim 1, wherein said first and second elastic members (7),(8) have a lateral surface (10), and said member (1) and element (2) have a containing wall, and at least a portion of said lateral surface of one of said first and second elastic members (7),(8) contacts said containing wall.

3. The shock absorbing device according to claim 1, wherein the elongate structure is a ski pole or walking stick and is provided with a handgrip and said shock absorbing device is arranged on said structure corresponding to said handgrip.

4. The shock absorbing device according to claim 2, wherein said elongate structure is a ski pole or a walking stick comprising several components and said shock absorbing device is arranged corresponding to where two components are joined.

5. The shock absorbing device according to claim 4, wherein said shock absorbing device is arranged at least at two points of union of the components constituting the elongate structure.

* * * * *